United States Patent [19]

Martin

[11] 4,415,082

[45] Nov. 15, 1983

[54] MULTI-UNIT PACKAGE

[75] Inventor: Claude Martin, Deols, France

[73] Assignee: The Mead Corporation, Dayton, Ohio

[21] Appl. No.: 314,911

[22] Filed: Oct. 26, 1981

[30] Foreign Application Priority Data

Oct. 28, 1980 [GB] United Kingdom ..... 8034657
Jan. 22, 1981 [GB] United Kingdom ..... 8101997

[51] Int. Cl.[3] ..... B65D 65/00; B65D 75/00

[52] U.S. Cl. ..... 206/431; 206/620; 229/52 BC; 229/89; 229/DIG. 6; 229/52 R

[58] Field of Search ..... 206/602, 431, 206, 144; 229/52 BC, 89, DIG. 6, 52 R

[56] References Cited

U.S. PATENT DOCUMENTS 3,677,458 7/1972 Gosling ..... 206/602
3,758,021 9/1973 Gordon-Ross ..... 206/602

FOREIGN PATENT DOCUMENTS 2348858 4/1975 Fed. Rep. of Germany ..... 206/602
79167 9/1962 France ..... 206/602
2412472 8/1979 France ..... 206/602

*Primary Examiner*—Joseph Man-Fu Moy
*Attorney, Agent, or Firm*—Erwin Doerr

[57] ABSTRACT

The invention relates to a package accommodating a plurality of primary containers arranged in at least one row. The package includes a wrapper (10) of foldable sheet material wrapped about the containers and which partially can be removed whereafter each container is detachable from an adjacent container such that each detached container is left with a part of the wrapper (48–51) which provides a handle by which the container can be grasped.

13 Claims, 26 Drawing Figures

FIG. 4
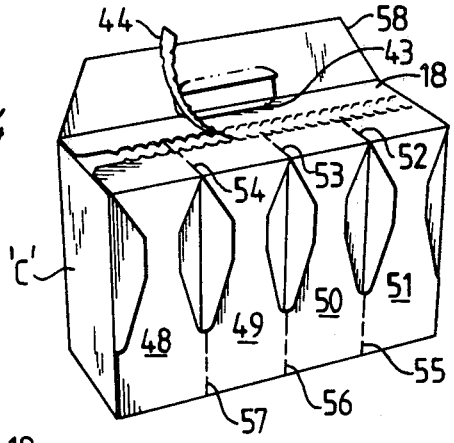
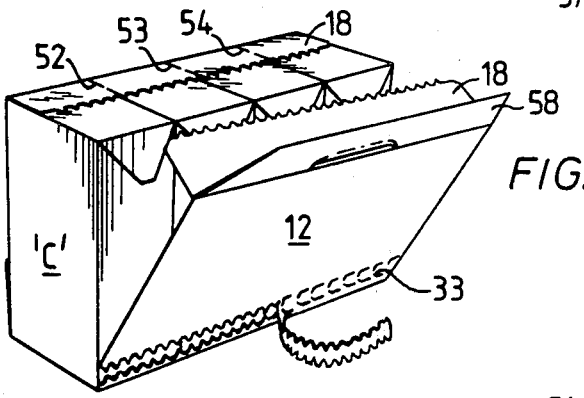
FIG. 5
FIG. 6
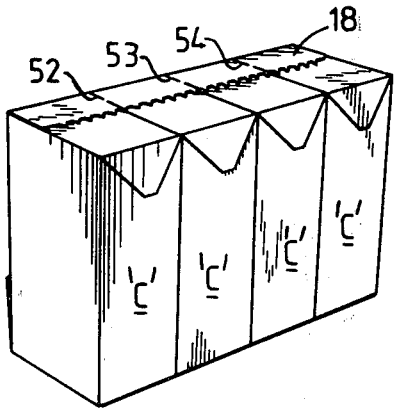

MULTI-UNIT PACKAGE

This invention relates to a package accommodating a plurality of uniform primary containers particularly, although not exclusively, containers of the type loaded with fluent contents and sealed for storage or disposal. The invention also relates to wrappers for forming such a package.

A recent trend in the packing of fluids such as milk and fruit juices has been to utilize sealed fluid-tight parallelepiped cartons which include means for forming a pouring spout or dispensing opening. Typical examples of such containers are found in U.S. patents to Rausing U.S. Pat. No. 3,759,359, Carlsson U.S. Pat. No. 4,113,103, Martensson U.S. Pat. No. 4,126,263 and Carlsson U.S. Pat. No. 4,197,494. While convenient and relatively inexpensive, these containers have the disadvantage, in use, that when the sides of the container are grasped for pouring, the fluent contents tend to spurt from the opening or mouth of the container.

The present invention not only provides a convenient package in which a number of such containers can be accommodated within a wrapper to form a multi-pack unit, but also permits parts of the wrapper to remain, and provide a handle for each container when the package is opened. This latter feature is particularly advantageous in that it obviates the necessity of grasping a container by its sides and so greatly minimizes the problem of uneven flow when the contents of the container are dispensed.

One aspect of the present invention provides a package comprising a plurality of containers arranged in at least one row, the package having a wrapper of foldable sheet material which includes, for each container, a strip of material extending between upper and lower ends of one face of that container to provide a handle by which the container can be grasped, said handle strip lying adjacent to, but detached from the container, characterized in that adjacent containers in each row detachably are connected together by their respective handle strips, and in that at least one frangible zone is provided between neighboring strips to permit detachment of one container from the adjacent container without destroying said handle strip.

Some embodiments of the invention will now be described, by way of example, with reference to the accompanying drawings, in which:

FIGS. 4 to 8 are perspective views of the package showing successive steps taken to open the package;

FIGS. 10 and 11 are perspective views of a package utilizing the wrapper shown in FIG. 9 and in which FIG. 11 shows the package partially opened;

FIGS. 13 to 15 are perspective views of a modified package according to the invention having a wrapper suitable for accommodating a single row of uniform containers and in which FIG. 15 shows the package partially open;

FIGS. 23 and 24 are perspective views of a package formed from the wrapper blank shown in FIG. 22 and in which FIG. 24 shows the package partially opened;

Figure 1:
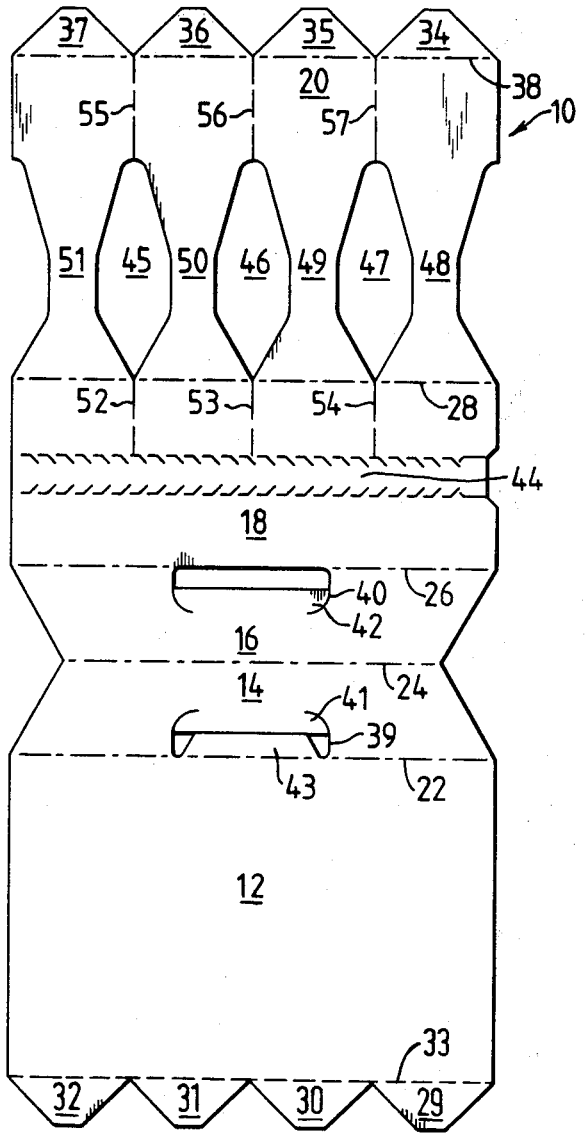
FIG. 1 is a plan view of a wrapper blank for forming a package according to the invention suitable for accommodating a single row of uniform containers.

Referring to the drawings and first to FIG. 1 thereof, there is shown an elongate wrapper blank 10 formed from paperboard or similar sheet material and which comprises a back panel 12, handle panel 14, handle panel 16, a top panel 18 and a front panel 20 hinged one to the next along transverse fold lines 22, 24, 26 and 28 respectively. The wrapper is suitable for packaging a single row of containers.

The back panel 12 has hinged along its free transverse edge a base panel comprising a series of truncated triangular flaps 29–32 which are spaced apart from one another and hinged to the back panel 12 along a common score line 33. Similarly, the front panel 20 has hinged along its free transverse edge a base panel comprising a series of truncated triangular flaps 34–37 which are spaced apart from one another and hinged to the front panel 20 along a common fold line 38.

The handle panels 14 and 16 are of similar configuration to one another about the central transverse fold line 24 and include hand gripping apertures 39, 40, respectively, struck from the blank 10. The hand gripping aperture 39 is provided with a hinged hand cushioning flap 41 and the hand gripping aperture 40 is provided with a hinged hand cushioning flap 42. A glue flap 43 is hinged to the back panel 12 along transverse fold line 22 and projects into the hand gripping aperture 39 towards the hand cushioning flaps 41.

The top panel 18 is provided with a transversely extending tear-away strip 44 to facilitate opening the package.

The front panel 20 is formed with three elongate apertures 45, 46 and 47 which are struck from the blank and shaped so as to form between them four similar waisted strips 48–51 extending longitudinally of the blank.

The top panel 18 is formed with frangible zones comprising three spaced score lines 52, 53 and 54 which extend longitudinally of the blank and meet with one end of each of the apertures 45, 46 and 47 respectively. Similarly, the front panel 20 is formed with frangible zones comprising three score lines 55, 56 and 57 which extend longitudinally of the blank from the opposite ends of the apertures 45, 46 and 47, respectively to the spaces between the adjacent truncated triangular flaps 34–37.

In order to form the package the complete handle structure 58 (FIGS. 2 and 4) is formed by first applying an application of glue to the handle panels 14 and 16 and the glue flap 43 after which the handle panels are then brought into face-to-face contact by folding about the transverse fold line 24 so that the two handle panels 14 and 16 are adhered together, whereby the hand gripping apertures 39 and 40 are brought into register with one another. During this operation the glue flap 43 is passed through the hand gripping aperture 40 and adhered to the top panel 18.

Figure 2:
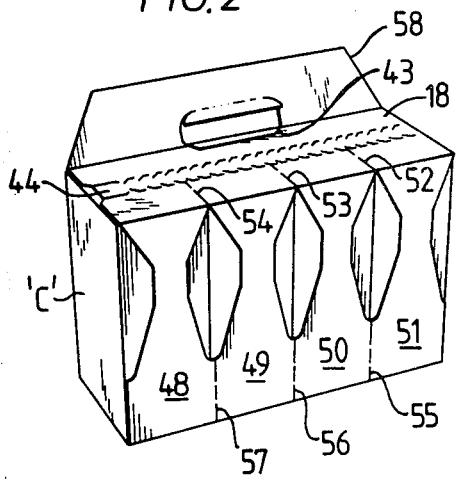
FIGS. 2 and 3 are perspective views of a package utilizing the wrapper shown in FIG. 1.
Figure 3:
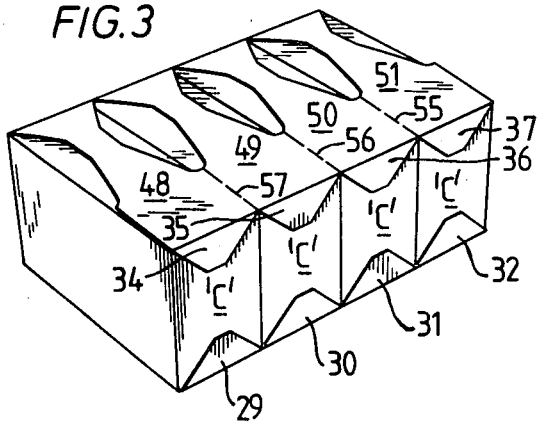

A further application of glue is then made to the top panel between tear-away strip 44 and fold line 28 and to all the truncated triangular flaps. The pre-glued blank is then wrapped about a row (in this case four) of parallelepiped primary containers 'c' by causing the blank to be folded about transverse fold lines 22 and 28 so that the top panel 18 abuts and the glued area thereof is adhered to the top faces of the containers 'c' with the back panel 12 and front panel 20 extending perpendicularly thereto. Thereafter the two series of truncated triangular flaps 29–32 and 34–37 are folded about their respective transverse fold lines 33 and 38 and adhered to the bottom faces of each of the containers 'c'. The package thus formed is illustrated in FIG. 2 from which it will be seen that the handle structure 58 is upstanding from the top panel 18 at the junction between the top panel 18 and the back panel 12. As shown in FIG. 3, the two series of truncated triangular flaps are adhered along the bases of the primary packages in spaced relationship. Hence, the frangible zones of the wrapper, that is, score lines 52–57 are coincident with the gaps between adjacent containers.

In order to open the package the tear-away strip 44 is torn and removed so that the top panel 18 is divided into two portions whereafter the unglued part of the top panel 18 together with handle structure 58 and back panel 12 is hinged away from the series of primary containers 'c' and subsequently completely detached therefrom by tearing along the score line 33, as illustrated in FIGS. 4 and 5 of the drawings, so as to expose one side of each of the primary containers 'c' as shown in FIG. 6 of the drawings.

Figure 7:
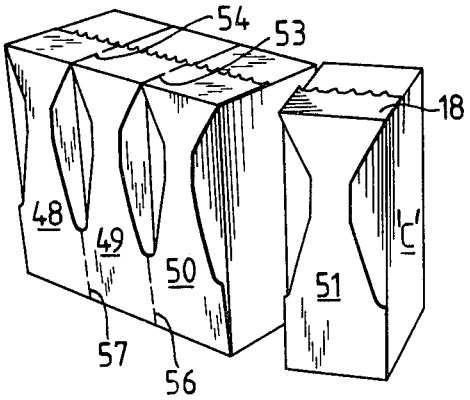

Referring now to FIG. 7 of the drawings it will be seen that after this procedure the package now consists of a row of primary containers 'c' to which is attached the remaining portion of the top panel 18, the front panel 20 (unglued) and both series of truncated triangular flaps.

The primary containers may not be detached one from the next by pulling the containers apart so that the package tears along the longitudinal score lines 52–54 and 55–57 between the adjacent strips 48–51 without destroying the strips.

Figure 8:
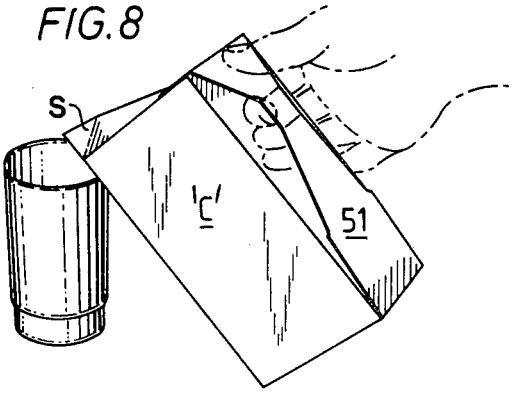

As shown in FIG. 8 of the drawings, each individual container 'c' after detachment is thereby provided with one of the waisted strips 48–51 which extends between the top and base walls of the container so as to provide a handle by which the container may be grasped. It will be appreciated that once the container has been opened and the pouring spout 's' has been formed, the handle facilitates pouring of the fluent contents as illustrated in FIG. 8 of the drawings.

In a further embodiment of the invention (not shown) it is envisaged that the carrying handle 58 comprising handle panels 14 and 16 may be omitted in which case the back panel 12 is directly hinged to the top panel 18.

Figure 9:
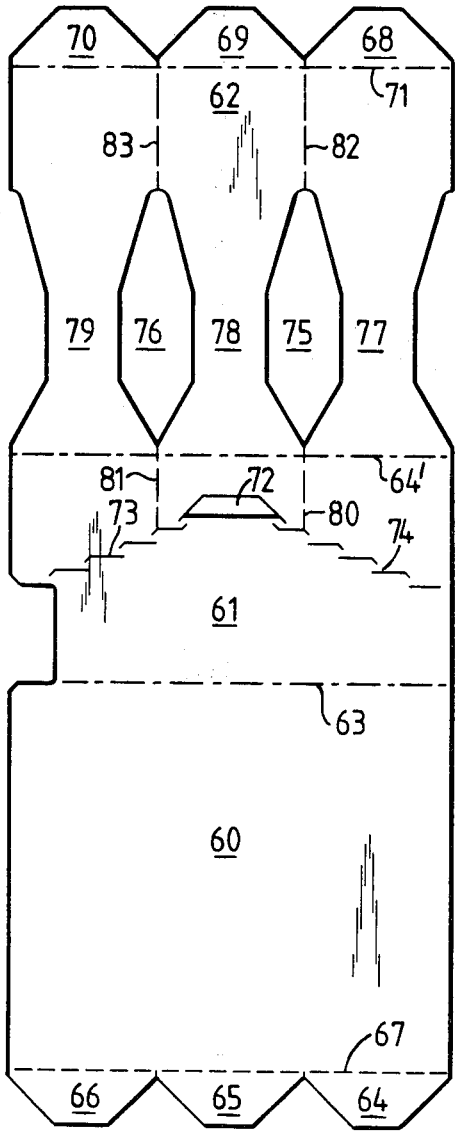
FIG. 9 is a plan view of another wrapper blank for forming a package according to the invention.

Referring now to FIG. 9–12 of the drawings, there is shown another embodiment of the invention for packaging a single row of primary containers. FIG. 9 shows an elongate wrapper blank 59 formed from paperboard or similar sheet material and which comprises a back panel 60, top panel 61 and a front panel 62 hinged one to the next along transverse fold lines 63 and 64 respectively.

The back panel 60 has hinged along its free transverse edge a series of truncated triangular flaps 64, 65 and 66 which are spaced apart from one another and hinged to the back panel 60 along a common score line 67. Similarly, the front panel 62 has hinged along its free transverse edge a series of truncated triangular flaps 68, 69 and 70 which are spaced apart from one another and hinged to the front panel 62 along a common fold line 71.

An aperture 72 is struck from the top panel 16 from which extends a pair of divergent series of score lines 73, 74 respectively which terminates at the opposed longitudinal edges of the top panel 61. Thus, a tear-away panel is defined by the series of score lines 73, 74 and the transverse fold line 63, which facilitates opening the package.

The front panel 62 is formed with two elongate apertures 75 and 76 which are struck from the blank 59 and shaped so as to form three similar waisted strips 77, 78 and 79 extending longitudinally of the blank.

The top panel 61 is formed with frangible zones comprising two spaced score lines 80 and 81 of which score line 80 extends longitudinally of the blank from the series of score lines 74 to meet with one end of the aperture 75. Likewise score line 81 extends longitudinally of the blank from the series of score lines 73 to meet with one end of aperture 76. Similarly, the front panel 62 is formed with frangible zones comprising two score lines 82 and 83 aligned with score lines 80 and 81 respectively, and which also extend longitudinally of the blank from opposite ends of the apertures 75 and 76 respectively to the spaces between the adjacent truncated triangular flaps 68, 69 and 70.

Figure 10:
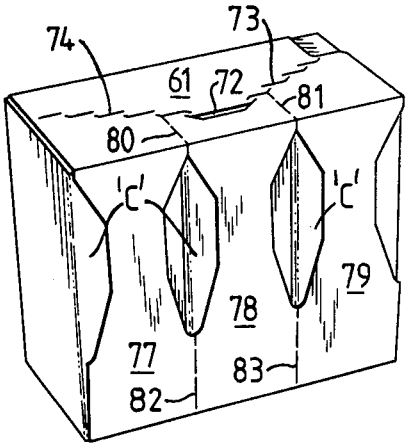
Figure 11:
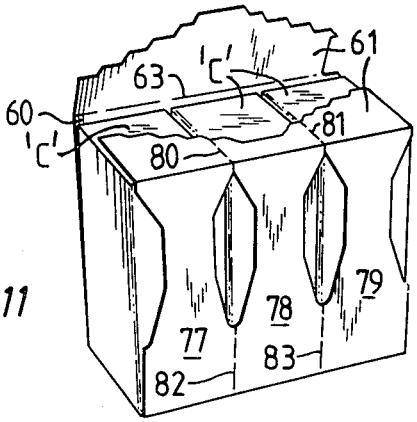

In order to form the package, an application of glue is made to the top panel 61 in the area defined between the series of score lines 73 and 74 and the transverse fold line 64'. Glue is further applied to all the truncated triangular flaps. The pre-glued blank is then wrapped about a row (in this case three) of parallelepiped primary containers 'c' (FIGS. 10 and 11) by causing the blank to be folded about transverse fold lines 63 and 64' so that the top panel 61 abuts, and the glued area thereof is adhered to, the top faces of the containers 'c' with the back panel 60 and front panel 62 extending perpendicularly thereto. Thereafter, the two series of truncated triangular flaps 64–66 and 68–70 are folded about their respective transverse fold lines 67 and 71 and adhered to the bottom faces of each of the containers 'c'. The package thus formed is illustrated in FIG. 10. It will be appreciated that the two series of truncated triangular flaps are adhered along the bases of the primary packages in spaced relationship as described in the previous embodiment with reference to FIGS. 1 to 8 of the drawings. Also, in common with the previous embodiment, the frangible zones, i.e. score lines 80–83, are coincident with the gaps between adjacent containers.

In order to open the package the tear-away panel is grasped at aperture 72 and torn away along the series of score lines 73 and 74 so that the top panel 61 is divided into two portions whereafter the unglued part of the top panel 61 together with the back panel 60 is hinged away from the row of containers 'c' and subsequently completely detached therefrom by tearing along the score line 67. The package is shown partially open in FIG. 11 of the drawings.

As is the case for the previous embodiment the package now consists of a series of containers 'c' to which is attached the remaining portion of top panel 61, the front panel 62 (unglued) and both series of truncated triangular flaps.

The primary containers 'c' may now be detached one from the next by pulling the containers apart so that the package tears along the longitudinal score lines 80, 81 and 82, 83 located between the adjacent strips 77, 78 and 79. Each individual container 'c', after detachment, thereby is provided with one of the waisted strips 77–79 which extends between the top and base walls of the container so as to provide a handle by which the container may be grasped, as previously described.

Figure 12:
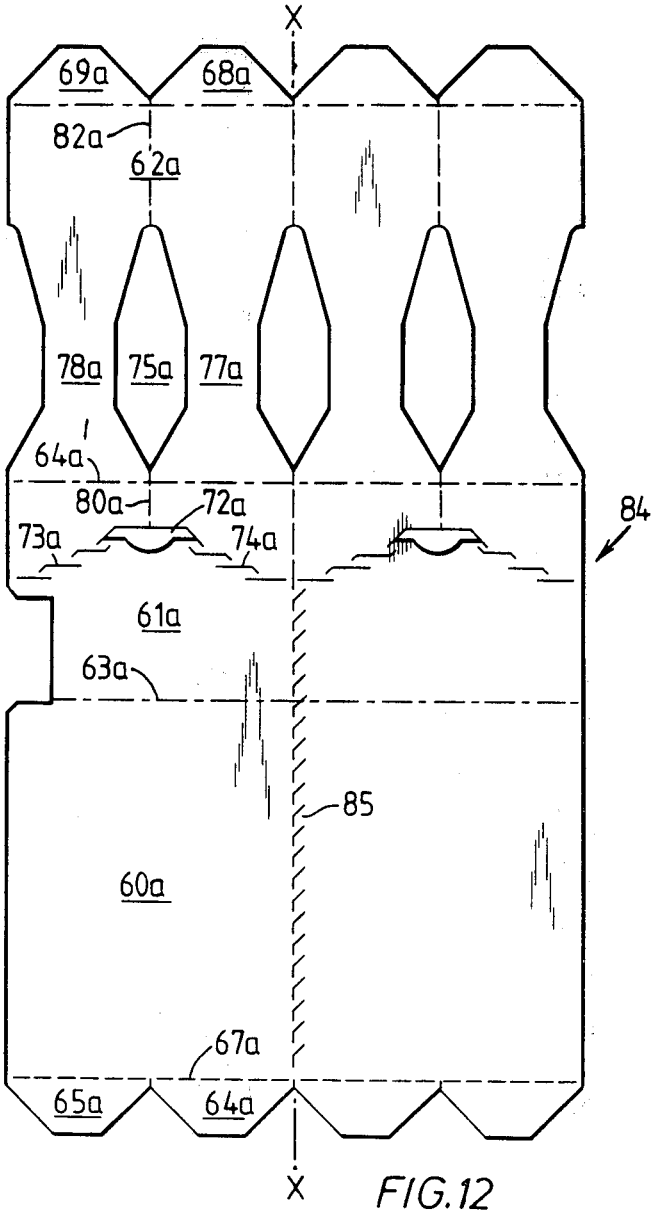
FIG. 12 is a plan view of a wrapper blank similar to that shown in FIG. 9.

FIG. 12 of the drawings shows a further blank 84 for forming a package comprising a row of four parallelepiped primary containers. The blank 84 is symetrical about the center line X—X and is similar in general construction to that described with reference to FIG. 9 of the drawings. Hence, the features of the blank to the left-hand side of the center line X—X have been enumerated with numerals designating similar parts to those illustrated in FIG. 9 but with the addition of suffix 'a'. The package formed from the blank 84 is achieved in a manner similar to that described with reference to FIGS. 9 to 11 and it will also be appreciated that the package is opened in a like manner. However, a central score line 85 is provided along the center line X—X so that the package may first be broken into two halves each containing a pair of primary containers which may then be separated from one another as previously described.

Figure 13:
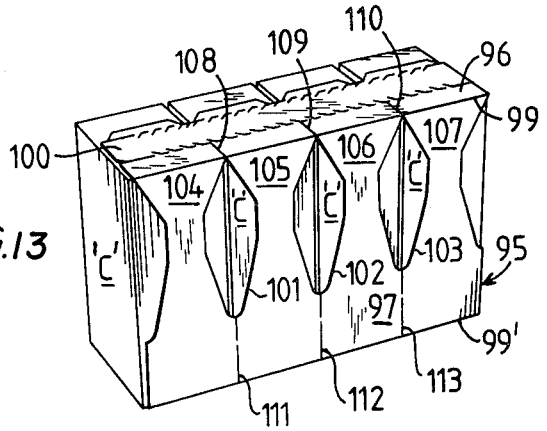
Figure 14:
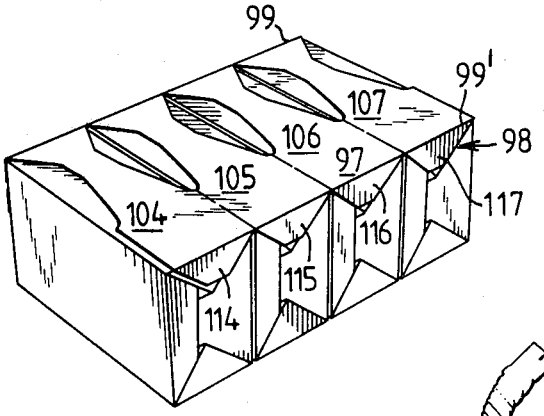
Figure 15:
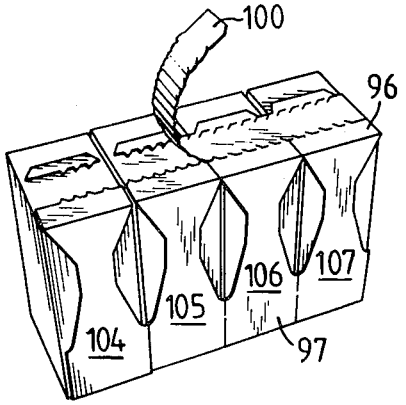

Referring now to FIGS. 13–15 of the drawings, there is shown a further embodiment of the invention but in which the package comprises a wrapper 95 which passes only partially around the packed containers 'c' and does not include a back panel as in the previous embodiments. The wrapper 95 is formed from paperboard or similar sheet material and comprises a top panel 96 and a front panel 97 and a base panel 98 hinged one to the next along transverse fold lines 99 and 99' respectively.

The top panel 96 is provided with a transversely extending tear-away strip 100 to facilitate opening the package.

The front panel 97 is formed with three elongate apertures 101, 102 and 103 which are struck from the wrapper 95 and shaped so as to form four similar waisted strips 104, 105, 106 and 107 extending longitudinally of the wrapper. The top panel 96 is formed with three spaced score lines 108, 109 and 110 which extend longitudinally of the wrapper and meet with one end of each of the apertures 101, 102 and 103 respectively. Similarly the front panel 97 is formed with three score lines 111, 112 and 113 which are aligned with the score lines on the top panel 96 and extend longitudinally of the wrapper from the opposite ends of the apertures 101, 102 and 103 respectively to the spaces between adjacent truncated triangular flaps 114, 115, 116 and 117. The truncated flaps together form the base panel 98 and are hinged to respective ones of the waisted strips along their common fold line 99'.

In order to form the package an application of glue is made to the top panel on either side of the tear-away strip 100 and also to all the truncated triangular flaps. The pre-glued wrapper 95 is then wrapped about a row (in this case four) of parallelepiped primary containers 'c' by causing the wrapper to be folded about transverse fold lines 99 and 99' so that the top panel 96 abuts, and the glued areas thereof are adhered to, the top faces of the containers 'c' with the front panel 97 extending perpendicularly thereto. Thereafter, the truncated triangular flaps 114–117 are folded about the fold line 99' and adhered to the bottom faces of each of the containers 'c'.

In order to open the package the tear-away strip 100 is torn and removed so that the top panel 96 is divided into two parts. As shown in FIG. 15 of the drawings, it will be seen that after this procedure the package consists of a row of primary containers 'c' to which is attached the remaining portions of the top panel 96, the front panel 97 (unglued) and the series of truncated triangular flaps. The containers 'c' may now be detached one from the next by pulling the containers apart so that the package tears along the score lines 108, 109 and 110 and score lines 111, 112 and 113 between the adjacent handle strips 104–107. Thus after detachment, each individual container is provided with one of the waisted strips 104–107 which extends between the top and base walls of the container so as to provide a handle by which the container may be grasped.

Referring now to FIGS. 16–21, there is shown a further embodiment of the invention suitable for packaging two parallel rows of primary containers C1 and C2.

Figure 16:
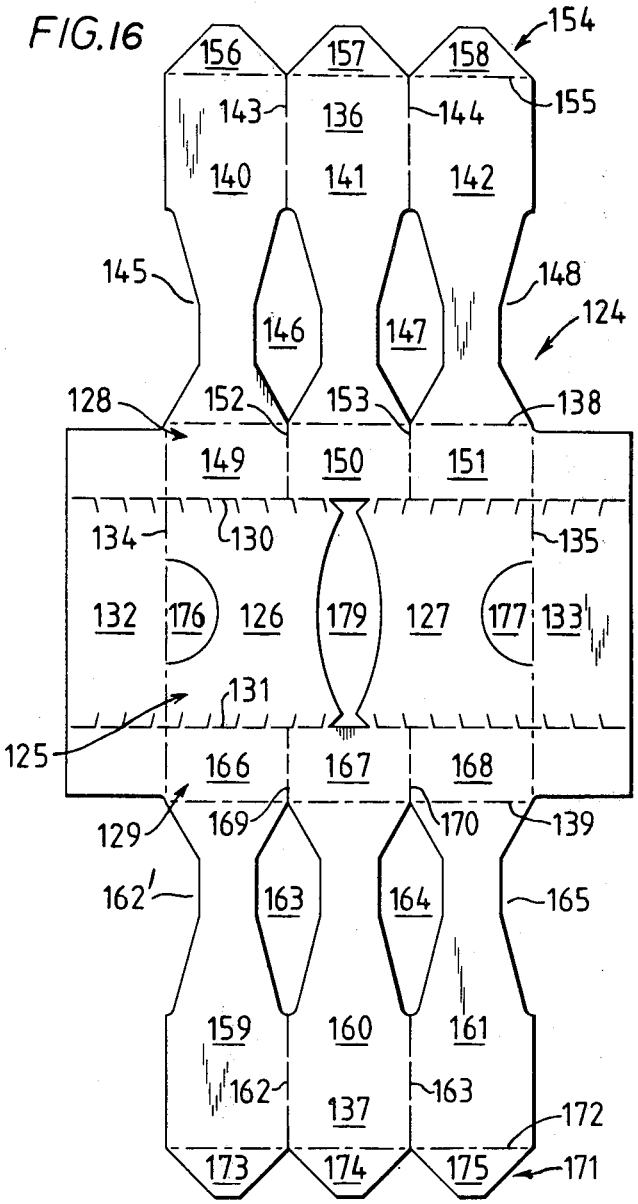
FIG. 16 is a plan view of another wrapper blank according to the invention and which is suitable for accommodating two rows of uniform containers.

FIG. 16 shows an elongate blank 124 formed from paperboard or similar foldable sheet material and which comprises a top panel 125 having two similar central portions 126, 127 to the opposite side edges of which is joined a pair of opposite outer portions 128, 129 of the top wall. The outer portions 128, 129 are joined to the central portions of the top wall along score lines 130, 131 respectively. A pair of side flanges 132, 133 are hinged to the opposite end edges of the central portions 126, 127 along fold lines 134, 135 respectively.

The blank 124 also includes a pair of side walls 136, 137 hinged to the outer portions of the top wall 128, 129 along fold lines 138, 139 respectively. The side wall 136 takes the form of three strips 140, 141 and 142 connected one to the next along score lines 143 and 144. Each of the side wall strips has a waisted zone between its ends formed by cut-out areas 145–148 of the side wall 136. Similarly, the outer portion 128 of the top wall is formed by three panels 149, 150 and 151 separated by score lines 152 and 153 which are aligned with the score lines 143 and 144 respectively. At the free edge of the side wall panel 136 a base panel 154 is hinged along a fold line 155. The base panel 154 takes and form of three truncated triangular tabs 156, 157 and 158 hinged to each of the strips 140, 141 and 142 respectively.

The opposite side wall 137 is of similar construction to that of side wall 136 and includes side walls strips 159, 160 and 161 connected one to the next by means of score lines 162 and 163. Strips 159, 160 and 161 also have a waisted configuration provided by cut-out areas 162–165 of the side wall panel 137. The outer portion 129 of the top wall is formed by three panels 166, 167, 168 separated by score lines 169, 170 which are aligned with the score lines 162 and 163 respectively. A base panel 171 is hinged to the side wall panel 137 along a fold line 172 and takes the form of three truncated triangular flaps 173, 174 and 175 hinged to each of the side wall strips 159, 160 and 161 respectively.

To facilitate carrying the completed package, a pair of arcuate tabs 176, 177 are struck from the central portions 126, 127 respectively of the top wall panel 125.

Figure 17:
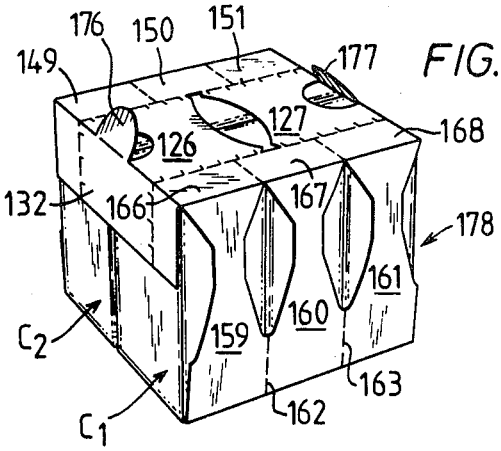
FIGS. 17 to 21 are perspective views of a package formed from the wrapper blank illustrated in FIG. 16 showing successive steps taken to open the package.

Referring now to FIG. 17 of the drawings, in order to form the completed package 178, as illustrated, two rows C1 and C2 of cartons are brought together in side-by-side relationship with three cartons in each row. The paperboard blank 124 is then wrapped about the two rows of cartons after first causing an application of glue to be made to the outer portions 128 and 129 of the top wall panel 125 and also to the side flanges 132, 133. Thus, when the top wall panel 125 is brought into overlying engagement with the tops of the cartons each of the outer portions 128 and 129 adhere to parts of the carton tops in each row and the side flanges are folded downwardly about their respective fold lines 134, 135 to engage and adhere to upper portions of the sides of the end most cartons in each row. The side wall panels 136 and 137 are then folded downwardly about their fold lines 138, 139 respectively so that each of the strips 140, 141 and 142 lie adjacent the outwardly facing sides of the cartons in one row and each of the strips 159, 160 and 161 lie adjacent the outwardly facing sides of the cartons in the other row. The base panels 154 and 171 are then provided with an application of glue and folded about their fold lines 155 and 172 respectively to engage the bases of the cartons. Thus, each of the truncated triangular flaps 156–158 and 173–175 is adhered to a different one of the packaged cartons. It will be appreciated that the side flanges 132 and 133 assist in maintaining the two rows C1, C2 of the cartons in their side-by-side relationship. However, it is envisaged that the side flanges could be excluded in which case some other means of keeping the carton rows together would be provided. For example, adhesive tape could be applied to the carton bases to hold the rows together. Alternatively, the bridging panel construction described with reference to FIG. 26 hereafter could be utilized.

In order to facilitate the manipulation of the completed package the arcuate tabs 176, 177 are displaced upwardly from central portions 126, 127 respectively of the top wall panel so as to hinge about the fold lines 134 and 135.

Figure 18:
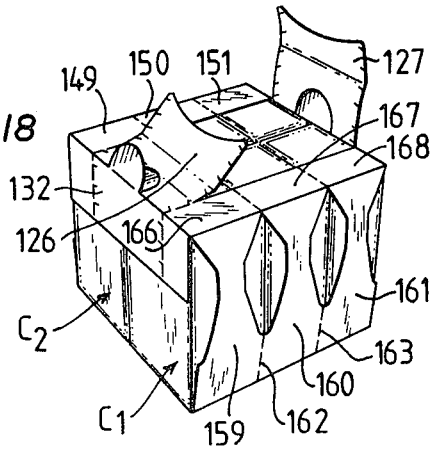
Figure 19:
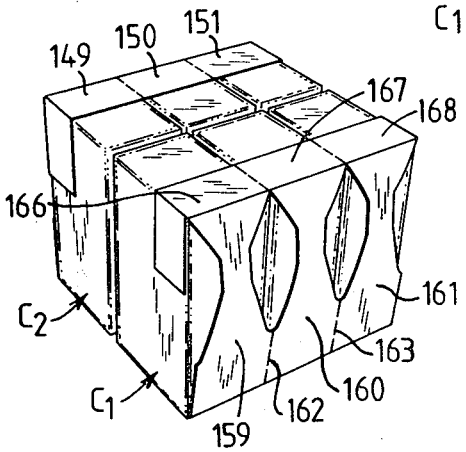
Figure 20:
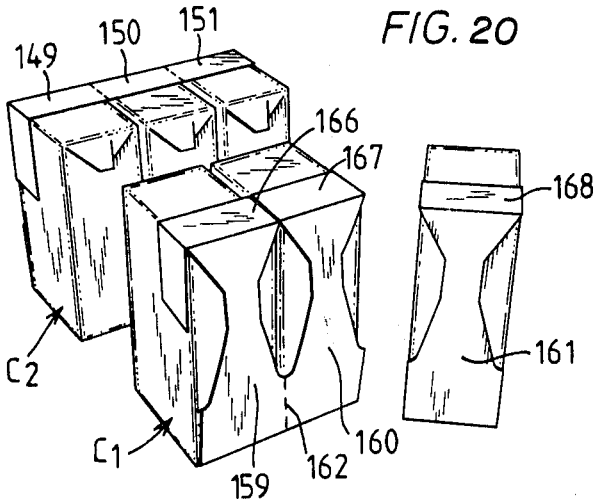

Referring now to FIG. 18 of the drawings, in order to open the package each of the top wall panels 126 and 127 are grasped by means of the central aperture 179 (FIG. 16) and pulled apart so that the sleeve is torn along score lines 130 and 131. As shown in FIG. 19 both the central portions of the top wall panel, 126 and 127, are completely removed together with central areas of the side flanges 132 and 133 thereby facilitating the separation of the two rows C1 and C2 of the cartons. As illustrated in FIG. 20 of the drawings the cartons in row C1 are connected one to the next by the outer portions of the top wall 129, i.e. by panels 166, 167 and 168, side wall strips 159, 160 and 161 (unglued) and base flaps 173, 174 and 175. It will be appreciated that only the outer portions of the top wall and the base flaps are adhered to the cartons, the side wall strips merely lying adjacent to but free from the sides of the cartons. The cartons in row C2 are similarly attached to corresponding parts of the outer portion of blank 124 (see FIG. 21).

The cartons in row C1 may then be detached one from the next by tearing along the score lines 169 and 170 which separate the three panels 166, 167 and 168 and the score lines 162 and 163 which separate each of the side wall strips 159, 160 and 161. For example, the carton 'X' (FIG. 21) which is furnished with part 168 of top wall portion 129, and side wall strip 161 together with base flap 175 is detached from the adjacent carton by tearing along score lines 170 and 163 respectively. Other cartons in row C1 and also in row C2 are detached from one another in a similar manner.

Figure 21:
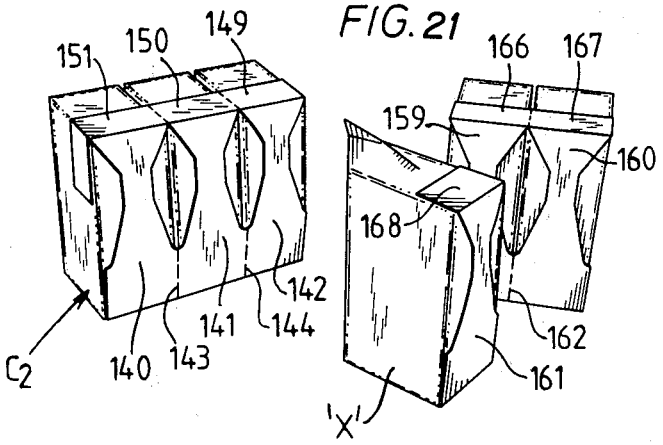

As shown in FIG. 21 of the drawings, each individual carton after detachment is provided with one of the waisted side wall strips which extends between the top and base of the carton. Since the waisted strip is free for limited movement away from the carton side wall, the waisted strip itself provides a handle by which the carton may be grasped. It will be appreciated that once the carton has been opened the handle thus provided facilitates pouring of the fluent contents. This handle feature is particularly advantageous in that it dispenses with the necessity of grasping the carton by its side walls which tends to cause the fluent contents to spurt from the opening when the carton is grasped. It is thought that such a feature would enable even a large capacity carton of (say) 2 liters suitable for sale. The force applied to the side walls of such a large capacity carton, in order to grip the carton for pouring, is such that spurting of the contents is a particular problem. By eliminating the necessity to grip the carton by its side walls, the problem of such uneven flow is greatly minimized.

Figure 22:
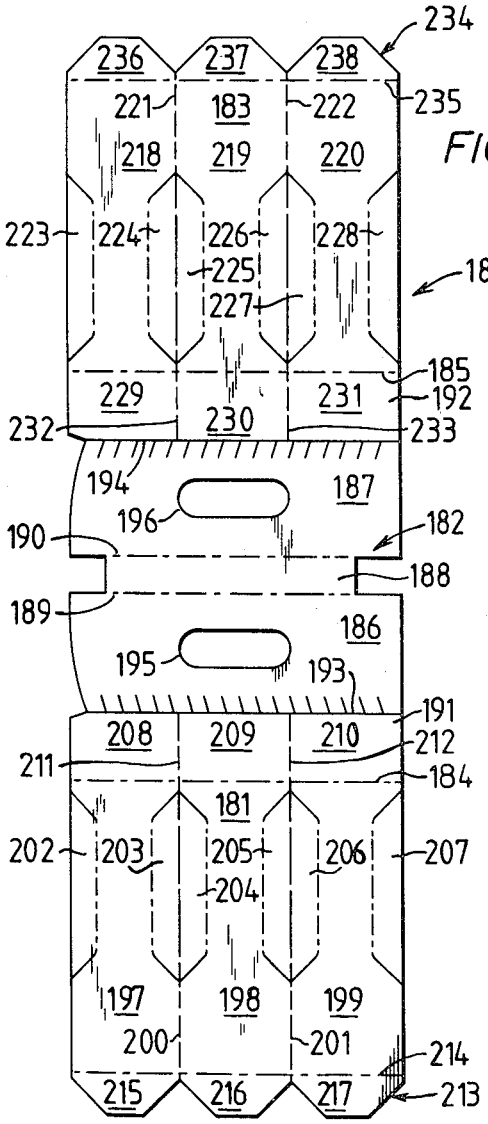
FIG. 22 is a plan view of another wrapper blank suitable for accommodating two rows of uniform containers.
Figure 23:
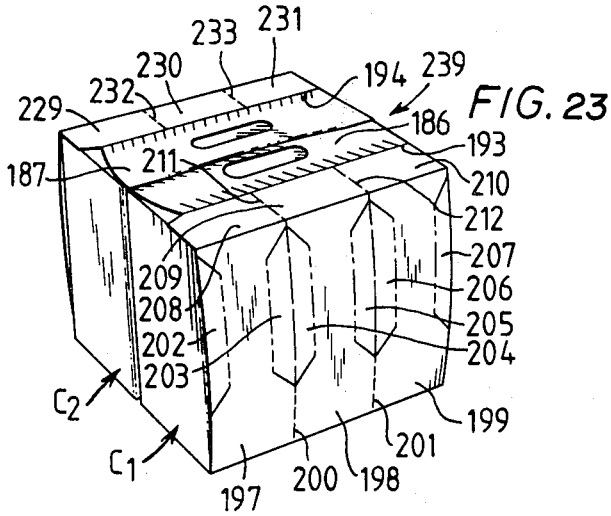
Figure 24:
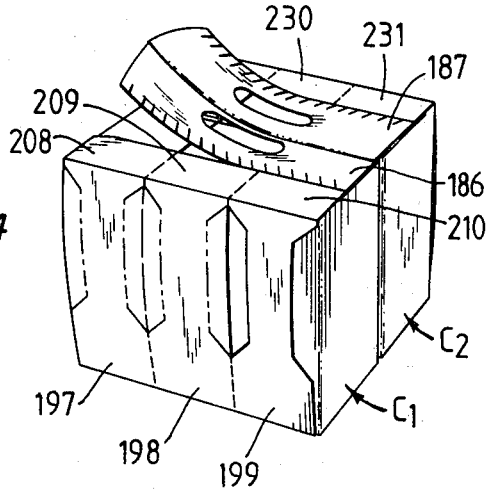

FIGS. 22 to 24 of the drawings illustrate a further embodiment of the invention for packaging two parallel rows of primary containers 'c'.

FIG. 22 shows an elongate wrapper blank 180 formed from paperboard or similar sheet material and which comprises a back panel 181, a top panel generally designated reference numeral 182 and a front panel 183 hinged one to the next along transverse score lines 184, 185 respectively.

The top panel 182 consists of two similar handle panels 186, 187 respectively connected together centrally of the blank by means of a bridging panel 188 along transverse fold lines 189, 190 respectively. The top panel 182 further consists of a pair of similar outer portions 191, 192 respectively. Outer portion 191 is hinged to the handle panel 186 along a transverse score line 193 and the outer portion 192 is hinged to handle panel 187 along transverse score line 194.

The outer portion 191 of the top wall and the back wall 181 are hinged together along the score line 184 and similarly the outer portion 192 of the top panel and the front wall 183 are hinged together along the transverse score line 185.

The handle panel 186 has struck therefrom a central hand gripping aperture 195 and likewise the handle panel 187 has struck therefrom a central hand gripping aperture 196.

The back panel 181 takes the form of three panels 197, 198 and 199 each of which panels has a waisted zone between its ends formed by hinged flaps 202, 203; 204, 205; and 206, 207.

The outer portion 191 of the top panel 182 also is formed by three panels 208, 209 and 210 separated from one another by score lines 211, 212 which are aligned with score lines 200, 201 respectively. At the free edge of the back panel 181, a base panel 213 is hinged along a fold line 214. The base panel 213 takes the form of three truncated triangular flaps 215, 216 and 217 hinged to each of the panels 197, 198 and 199 respectively.

The opposite front wall of the blank is of similar construction to that of back wall 181 and includes panels 218, 219 and 220 connected one to the next by means of score lines 221 and 222. Panels 218, 219 and 220 also have a waisted configuration provided by hinged flaps 223, 224; 225, 226; and 227, 228.

The outer portion 192 of the top wall panel 182 is formed by three panels 229, 230 and 231 separated from one another by means of score lines 232, 233 which are aligned with the score lines 221 and 222 respectively. At the free edge of front wall 183, a base panel 234 is hinged along fold lines 235. The base panel 234 takes the form of three truncated triangular flaps 236, 237 and 238 hinged to each of the panels 218, 219 and 220 respectively.

Referring now to FIG. 23 of the drawings, in order to form the completed package 239, as illustrated, two rows C1 and C2 of cartons are brought together in side-by-side relationship with three cartons in each row. An application of glue is then made to each of the outer portions 191, 192 of the top wall panel 182 and to the bridging panel 188 and also to all the truncated triangular flaps of base panels 213 and 234.

The bridging panel 188 is then folded about the trnasverse fold lines 189, 190 so as to bring the adjacent edges of the two handle panels 186 and 187 into overlapping relationship.

The top wall panel 182 is brought into overlying engagement with the tops of the cartons so that each of the outer portions 191, 192 adhere to parts of the carton tops in respective rows C1, C2 and the front and back wall panels 181, 183 are folded downwardly about their respective score lines 184, 185. Thus, each of the panels 197–199 lie adjacent to the outwardly facing sides of the cartons in one row and each of the panels 218–220 lie adjacent the outward facing sides of the cartons in the other row. The base panels 213, 234 are then folded about their respective fold lines 214, 235 to engage the bases of the cartons. Thus, each of the truncated triangular flaps 215–217 and 236–238 is adhered to a different one of the packaged cartons. It is envisaged that some means of keeping the carton rows together at their bases would be provided. For example, adhesive tape could be applied to the carton bases to hold the rows together. Alternatively, the bridging panel construction described with reference to FIG. 26 hereafter could be utilized.

Referring now to FIG. 24 of the drawings, in order to open the package the handle panels 186, 187 are grasped and the top wall panel 182 is torn along score lines 193 and 194. Therefore, both the handle panels are completely removed thereby failitating the separation of the two rows C1 and C2 of the cartons. After removal of the handle panels the cartons in row C1 are connected one to the next by the outer portions of the top wall 191, i.e. by panels 208, 209 and 210, panels 197, 198 and 199 (unglued) and bottom wall flaps 215, 216 and 217. It will be appreciated that only the panels 208, 209 and 210 and the base wall flaps 215, 216 and 217 are adhered to the cartons, the panels 197, 198 and 199 merely lying adjacent to but free from the sides of the cartons. The cartons in row C2 are similarly attached to corresponding parts of the other portion of the wrapper.

The cartons in row C1 may then be detached one from the next by tearing along the score lines 211 and 212 which separate the three panels 208, 209 and 210 and simultaneously tearing along the score lines 200 and 201 which separate each of the panels 197, 198 and 199. Of course, the cartons in row C2 may be detached one from the next in a similar manner.

Each individual carton after detachment is provided with one of the waisted side wall panels which extends between the top and base of the carton. In order to grasp a carton the flaps hinged to the waisted panel, e.g. flap 202 and 203 of panel 197, are folded inwardly towards one another about their respective fold lines thereby forming a strong two-ply handle which is free for limited movement away from the carton side wall.

Figure 25:
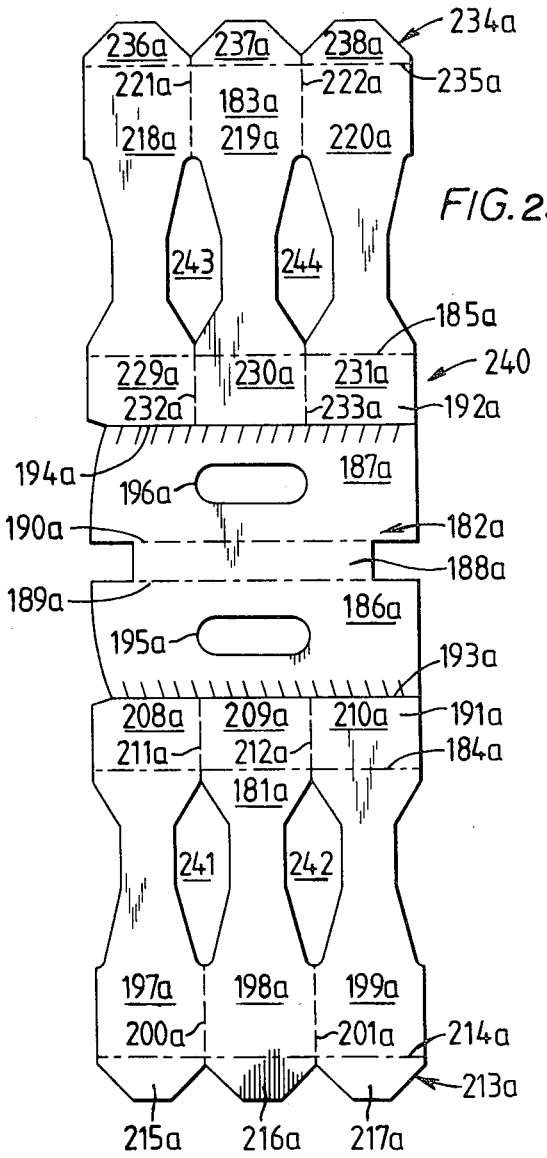
FIG. 25 is a plan view of another wrapper blank similar to that shown in FIG. 22.

FIG. 25 illustrates a wrapper blank 240 which is similar to the blank illustrated in FIG. 34 and in which like parts designate like reference numerals with the addition of the suffix 'a'.

In this particular construction the hinged flaps 202–207 and 223–228 of FIG. 22 have been completely struck from the blank as in other prior embodiments described thus leaving a pair of apertures 241 and 242 in the front wall panel **181*a* and a pair of apertures 243 and 244 in the front wall panel 183*a***.

Figure 26:
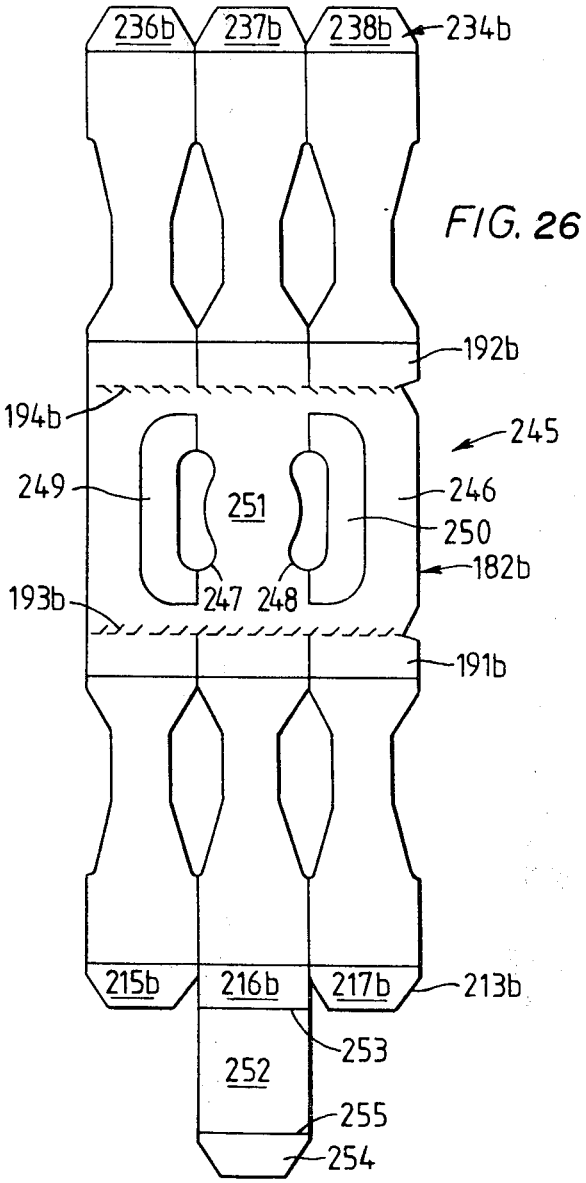
FIG. 26 is a plan view of a modified wrapper blank similar to that shown in FIG. 25.

A further wrapper blank 245 is illustrated in FIG. 26 of the drawings which is similar to the blank illustrated in FIG. 25 and in which like parts are designated like reference numerals with the addition of the suffix 'b'. Blank 245 has a modified top panel **182*b* and a modified base panel 213*b***.

In the modification the handle panels **186*a* and 187*a* of blank 240 have been replaced by a single handle panel 246. The handle panel 246 is connected to the outer portions 191*b* and 192*b* of the top wall panel 182*b* by means of tear-away strips 193*b* and 194*b* respectively. Hand gripping apertures 247 and 248 are struck from the handle panel 246 and extend longitudinally of the blank. The hand gripping apertures are supplemented by a pair of foldable reinforcement panels 149, 150 which are hinged adjacent respective ones of the hand gripping apertures 247, 248. In use, the reinforcement panels 249, 250 are folded towards one another into overlapping relationship with the underside of the handle panel 246 and thereby provide a strengthened two-ply handle 251 located between the hand gripping apertures 247 and 248**.

The modification provided by the base panel **213*b* is that the central flap 216*b* has been extended to form a bridging panel 252 hinged to the flap 216*b* along a transverse fold line 253 and which terminates in an anchor flap 254 which is hinged to the bridging piece 252 along a transverse fold line 255**.

When the blank 245 is applied to the double row of cartons, all the base flaps including flap **216*b* are adhered to the respective bases of the cartons to be packaged. During this operation the bridging panel 252 is folded away from the carton bases along fold line 253. An application of glue is then made to the anchor flap 254 and the bridging flap 252 is folded about fold line 253 so that it extends across the base of the carton to which flap 216*b* is adhered whereby the anchor flap 254 is then adhered to the immediately opposite carton in the adjacent row. By this means the gap between the two carton rows is bridged and the bridging piece 252 together with its integral anchor flap 254** provide means by which the carton rows are held together to prevent the carton rows from moving apart at their bases.

Whereas glueing of the wrappers to the containers is specifically referred to, it is envisaged that other means of securing the wrappers to the containers may be utilized. Fo example, the wrappers suitably treated may be secured by heat sealing.

It is also envisaged that a weakened area to produce an aperture may be present on the top face of each container. Such weakened area may be punctured to form an aperture to permit ingress of air into the container during pouring so as to further aid even-flow dispensing. An aperture in the wrapper may be required to allow access to the weakened area of the carton or the weakened area may be positioned beneath the removable portion (when present) of the wrapper top panel.

What is claimed is:

1. A package comprising a plurality of parallelepiped containers arranged in at least one row and accommodated within a wrapper of foldable sheet material adapted to cover at least portions of the tops, sides and bottoms of said containers and secured to at least portions of each of said containers, said wrapper comprising a top panel, a front panel hinged to said top panel along one side edge thereof and extending between the upper and lower ends of said containers, and a base panel hinged to said front panel remote from said top panel, said front panel being formed to provide at least one handle strip for each container, said handle strips being detachably connected to adjacent strips by means of frangible connections, each of said handle strips having its opposite ends integral with adjacent portions of said top panel and said base panel, said adjacent portions being secured to the top and bottom, respectively, of said container while said handle strip is left detached from the underlying wall of said container, said adjacent portions being provided with tear lines in extension of said frangible connections between said handle strips so that individual containers may be detached from each other while said handle strip and said adjacent portions remain associated with said containers.

2. The package according to claim 1 wherein said base panel comprises a plurality of spaced flaps, each of which flaps is secured to a separate one of said containers.

3. The package according to claim 1 further characterized in that said top panel comprises a removable portion and said tear lines provided in said adjacent portions of said top panel extend between an edge of said removable portion and said frangible connections.

4. The package according to claim 1 wherein said wrapper includes a back panel hinged to the other side edge of said top panel and extending between the upper and lower ends of said containers at the other side thereof, and a further base panel hinged to said back panel remote from said top panel and secured to the bottoms of said containers opposite to said base panel associated with said front panel.

5. The package according to claim 1 further characterized in that said removable portion of the top panel (18) comprises a tear-away strip (44) extending along the row of said containers transversely with respect to said top panel score lines (52, 53, 54).

6. The package according to claim 1 further characterized in that said removable portion of the top wall (18) includes a part hinged to a handle structure (58) upstanding from said top wall and comprising a pair of hinged handle panels (14, 16) and in that a back panel (12) is hinged to one of said handle panels (14) and extends between upper and lower ends of the opposite face of each container, a further base panel being detachably connected to the lower end of said back panel and comprising a plurality of spaced flaps (29, 30, 31, 32) each of which flaps is secured to a separate one of said containers in the row.

7. The package according to claim 3 further characterized in that said removable portion of the top wall (61) is hinged to a back panel (60) extending between upper and lower ends of the opposite face of each container, a further base panel being detachably connected to the lower end of said back panel and comprising a plurality of spaced flaps (64, 65, 66) each of which flaps is secured to a separate one of said containers in the row.

8. The package according to claim 1 having a pair of parallel rows of containers further characterized in that the wrapper (124) comprises a top panel (125, 128, 129) secured to the tops of the containers in each row (C1, C2), a pair of side walls (136, 137), one side wall being hinged to one edge of said top wall and extending between said upper and lower ends of an outer face of one row of containers and the other side wall (137) being hinged to the opposite edge of said top wall and extending between upper and lower ends of an outer face of the other row of containers, a base panel (154) hinged to said one side wall and secured to lower parts of the containers in said one row, a base panel (171) hinged to said other side wall and secured to lower parts of the containers in said other row, each of said side walls comprising said handle strips (140, 141, 142 and 159, 160, 161) defined in part by struck out portions (145–148 and 162–165) of the respective side wall, and said base panels each comprising a plurality of spaced flaps (156–158 and 173–175) each of which flaps is secured to a separate one of said containers in the respective rows, said top panel and said side walls all having said frangible zones located to coincide with the space between adjacent containers in each row.

9. The package according to calim 8 further characterized in that said top panel (125, 128, 129) comprises outer portions (128, 129) each being permanently secured to the tops of the containers in respective rows, and a removable portion (125) between and detachably connected to said outer portions, said frangible zones of the top panel comprising first spaced score lines (152, 153) coincident with the space between adjacent containers in said one row, each of said first score lines (152, 153) extending between one edge of said removable portion (125) and one end of respective ones of the adjacent struck out portions (146, 147) and second spaced score lines (169, 170) coincident with the space between adjacent containers in said other row, each of said second score lines (169, 170) extending between the opposite edge of said removable portion (125) and one end of respective ones of the adjacent struck out portions (163, 164).

10. The package according to claim 9 further characterized in that the frangible zones of said one side wall (136) comprise spaced score lines (143, 144) coincident with the space between adjacent containers, each score line (143, 144) extending between the opposite end of a respective one of the adjacent struck out portions (146, 147) and the gap between respective ones of the adjacent base flaps (156, 157. 158) and in that the frangible zones of said other side wall (137) comprise spaced score lines (162, 163) coincident with the space between adjacent containers, each score line (162, 163) extending between the opposite end of a respective one of the adjacent struck out portions (163, 164) and the gap between respective ones of the adjacent base flaps (173, 174, 175).

11. The package according to claim 9 further characterized in that said removable portion (125) of the top panel includes handle means (176, 177) to facilitate portage of the package.

12. The package according to claim 8 further characterized in that means (252, 254) is provided to prevent the lower parts of the containers of one row moving away from the lower parts of the containers in the other row.

13. The package according to claim 12 further characterized in that said means comprises a bridging panel (252) hinged to one of said base flaps (216*b*) and extending across the gap between the pair of container rows, said bridging panel terminating in an anchor panel (254) secured to the base of a container which is directly opposite to the container which has said one base flap (216*b*) secured thereto.

* * * * *

UNITED STATES PATENT AND TRADEMARK OFFICE

CERTIFICATE OF CORRECTION

PATENT NO. : 4,415,082

DATED : November 15, 1983

INVENTOR(S) : Claude Martin

It is certified that error appears in the above-identified patent and that said Letters Patent is hereby corrected as shown below:

Column 3, line 43, "not" should read -- now --;

Column 4, line 10, reference numeral "16" should read -- 61 --;

Column 5, line 57, following "truncated" insert -- triangular --;

Column 6, line 47, "and" should read -- the --;

Column 11, line 45, the claim reference numeral "1" should read -- 3 --;

Column 11, line 50, the claim reference numeral "1" should read -- 3 --.

Signed and Sealed this

*Sixteenth* Day of *October 1984*

[SEAL]

*Attest:*

*Attesting Officer*

GERALD J. MOSSINGHOFF

*Commissioner of Patents and Trademarks*